US006935688B2

(12) United States Patent
LaPointe

(10) Patent No.: US 6,935,688 B2
(45) Date of Patent: Aug. 30, 2005

(54) FLUIDIC CONTROL MOUNTING SYSTEM

(75) Inventor: Larry P LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 60 days.

(21) Appl. No.: 10/397,009

(22) Filed: Mar. 25, 2003

(65) Prior Publication Data

US 2004/0189069 A1 Sep. 30, 2004

(51) Int. Cl.[7] ..... A47C 4/54

(52) U.S. Cl. ..... 297/284.6; 297/452.41; 297/DIG. 3; 5/655.5

(58) Field of Search ..... 297/452.56, 284.6, 297/DIG. 3; 5/713, 685, 654, 658.4

(56) References Cited

U.S. PATENT DOCUMENTS 5,562,324 A * 10/1996 Massara et al. ..... 297/284.6
5,634,225 A * 6/1997 Miller et al. ..... 5/710
5,652,985 A * 8/1997 Wilkinson et al. ..... 5/710
5,658,050 A * 8/1997 Lorbiecki ..... 297/452.41
5,660,438 A * 8/1997 Tedesco ..... 297/284.6
5,687,438 A * 11/1997 Biggie et al. ..... 5/654
5,893,184 A * 4/1999 Murphy ..... 297/452.41
5,902,011 A * 5/1999 Hand et al. ..... 297/284.6
5,991,949 A * 11/1999 Miller et al. ..... 5/710
6,209,159 B1 * 4/2001 Murphy ..... 5/654
6,240,945 B1 6/2001 Srinath et al.
6,253,782 B1 7/2001 Raghu
6,273,810 B1 * 8/2001 Rhodes et al. ..... 454/120
6,679,557 B2 * 1/2004 Craft et al. ..... 297/452.41
6,682,145 B2 * 1/2004 Wilkerson et al. ..... 297/284.6

* cited by examiner

*Primary Examiner*—Peter M. Cuomo
*Assistant Examiner*—Erika Garrett
(74) *Attorney, Agent, or Firm*—Harness, Dickey & Pierce, P.L.C.

(57) ABSTRACT

A mounting system for an air supply and control system used in an article of furniture is disclosed. The mounting system is especially suited for applications where the seat back has a hollow portion to contain the control system. The mounting system incorporates vinyl pouches attached to a plastic member that is attached to the seat back with elastic straps. Each vinyl pouch is suited for holding an air control assembly that can include an air pump, motor, and fluidic control device.

11 Claims, 5 Drawing Sheets

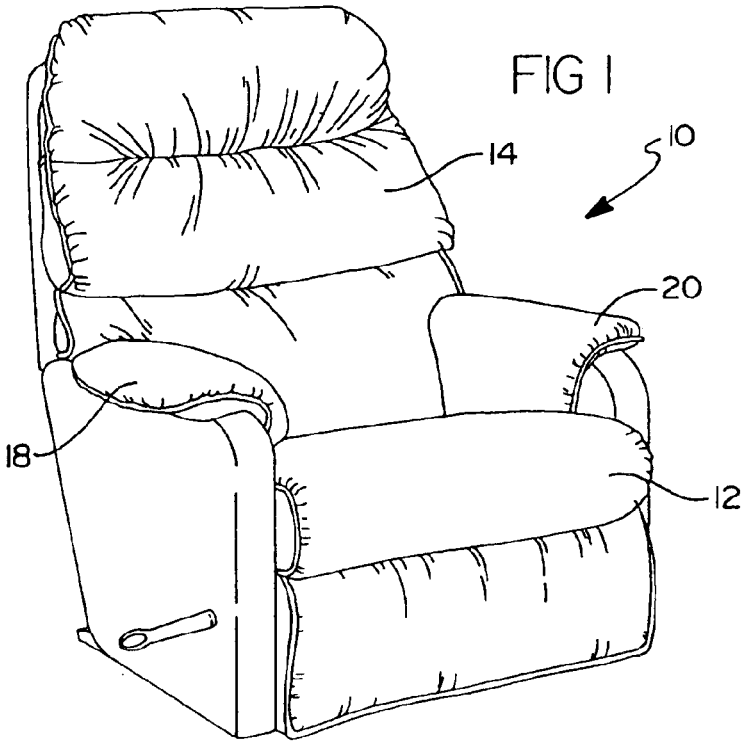
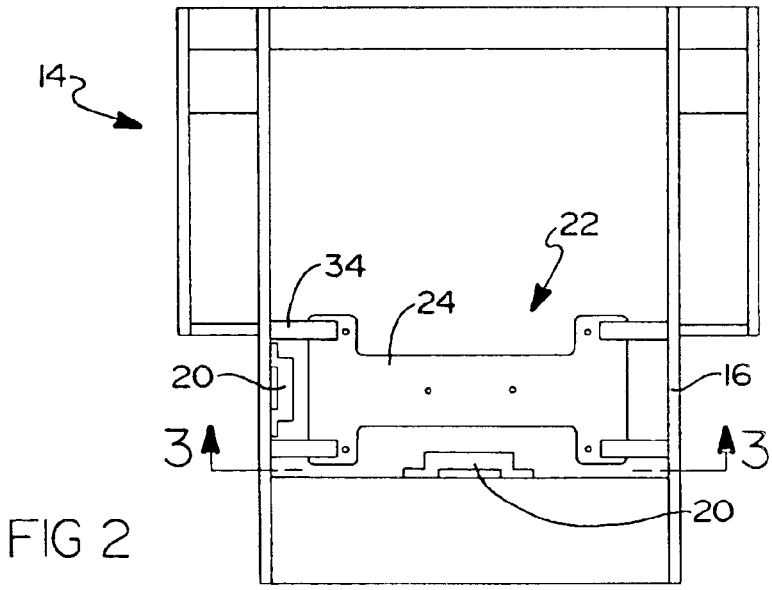
FIG 2

FLUIDIC CONTROL MOUNTING SYSTEM

FIELD OF THE INVENTION

The present invention relates generally to articles of furniture of the type having a fluidic pump that inflates lumbar or pneumatic massage assemblies. Typically, articles of furniture such as chairs may be supplied with lumbar supports or back/neck massage assemblies within the seat back. A lumbar can inflate an air pillow that is located within the seat back to expand a seat back portion that contacts the occupant of the chair. A back/neck massage assembly can be constructed of air pillows located in the seat back to apply pressure at alternating locations as the air pillows are inflated/deflated by a fluidic control system. The fluidic control system typically consists of at least one air pump and can consist of multiple air pumps that inflate various lumbar and massage air pillows. For a massage air pillow, a fluidic assembly such as disclosed in U.S. Pat. No. 6,253,784 can be used to oscillate the air flow from the pumps to inflate and deflate the air pillows which alternates or varies the locations that pressure is applied by the air pillows to the occupant. A typical location for the fluidic control system within an upholstered article of furniture is the internal portions of arm rests. Typically, the pumps and fluidic assemblies are mounted to the arm rest frame during furniture assembly. Thus, while some conventional fluidic control mounting systems operate satisfactorily for their intended purpose, furniture manufacturers are continually striving to develop improved fluidic control mounting systems that more readily dissipate heat and transmit less vibrations and noise to the chair occupant.

SUMMARY OF THE INVENTION

Accordingly, the present invention is directed to an improved fluidic control mounting system for use in articles of furniture. In one aspect of the present invention, a flexible plastic carrier plate is mounted within a seat back with elastic straps. The elastic straps are routed through apertures within either end of the carrier plate and the ends of the elastic straps are stapled to the wooden seat back frame. Pouches attached to the carrier plate are constructed of folded vinyl or rubber sheets that are open at the top end and contain the fluidic control system components such as pumps, motors, and fluidic assemblies with attached tubing. The elastic straps provide a desired vibration and noise isolation between the fluidic control system and chair frame and occupant.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a perspective view of an exemplary article of furniture having a fluidic control mounting system of the present invention;

FIG. 2 is a rear view of the article of furniture of FIG. 1 showing the fluidic control mounting system of the present invention;

DETAILED DESCRIPTION OF THE PREFERRED EMBODIMENTS

Figure 3:
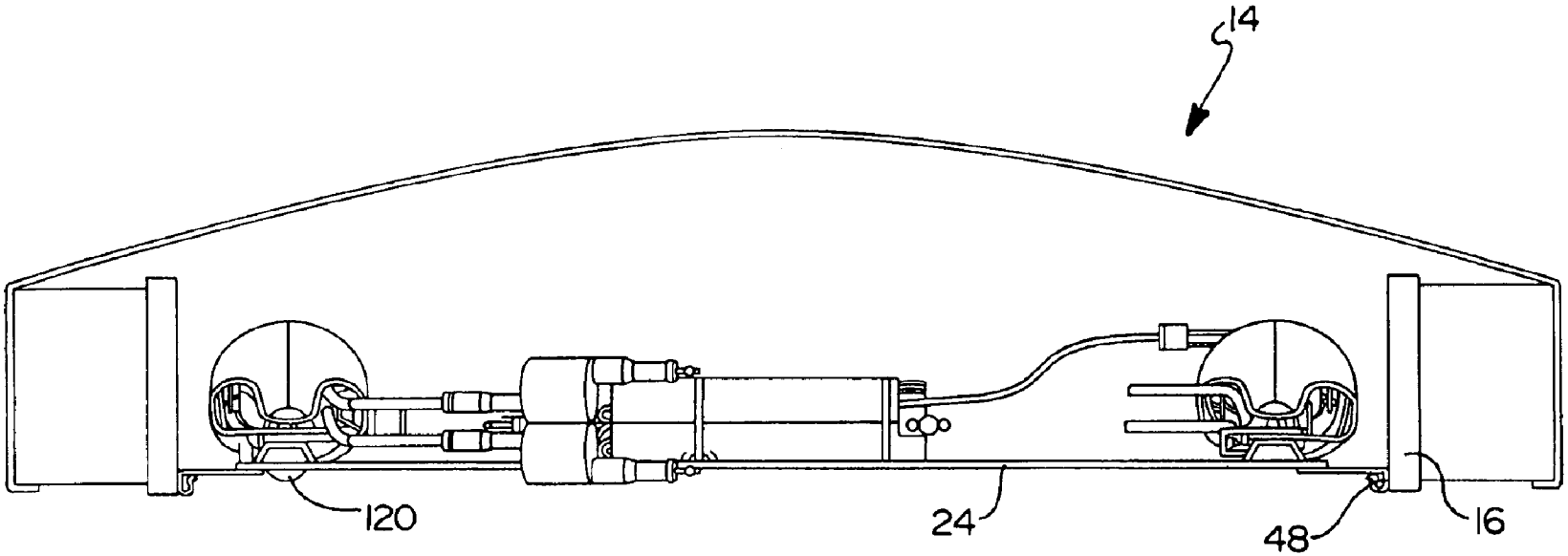
FIG. 3 is a sectional view taken along the line 3—3 of FIG. 2.

The following description of the preferred embodiment(s) is merely exemplary in nature and is in no way intended to limit the invention, its application, or uses.

With reference to FIGS. 1 and 2, an exemplary rocker recliner chair 10 is shown to include a chair bottom frame 12, a seat back 14 and a seat back frame 16. Preferably, seat back frame 16 is preferably constructed of wooden members and covered with upholstery 18. Seat back 14 incorporates an air pillow or combination of air pillows (not shown) that are positioned within seat back 14 The air lumbar pillow is inflated and deflated by a fluidic control system to adjust the volume of the lumbar air pillow. The pressure within the massage pillows is oscillated so as to exert pressure on a seat occupant thereby providing a massage feature. As best seen in FIG. 2, furniture components 20 and a fluidic control system 22 are mounted to seat back frame 16.

Figure 4:
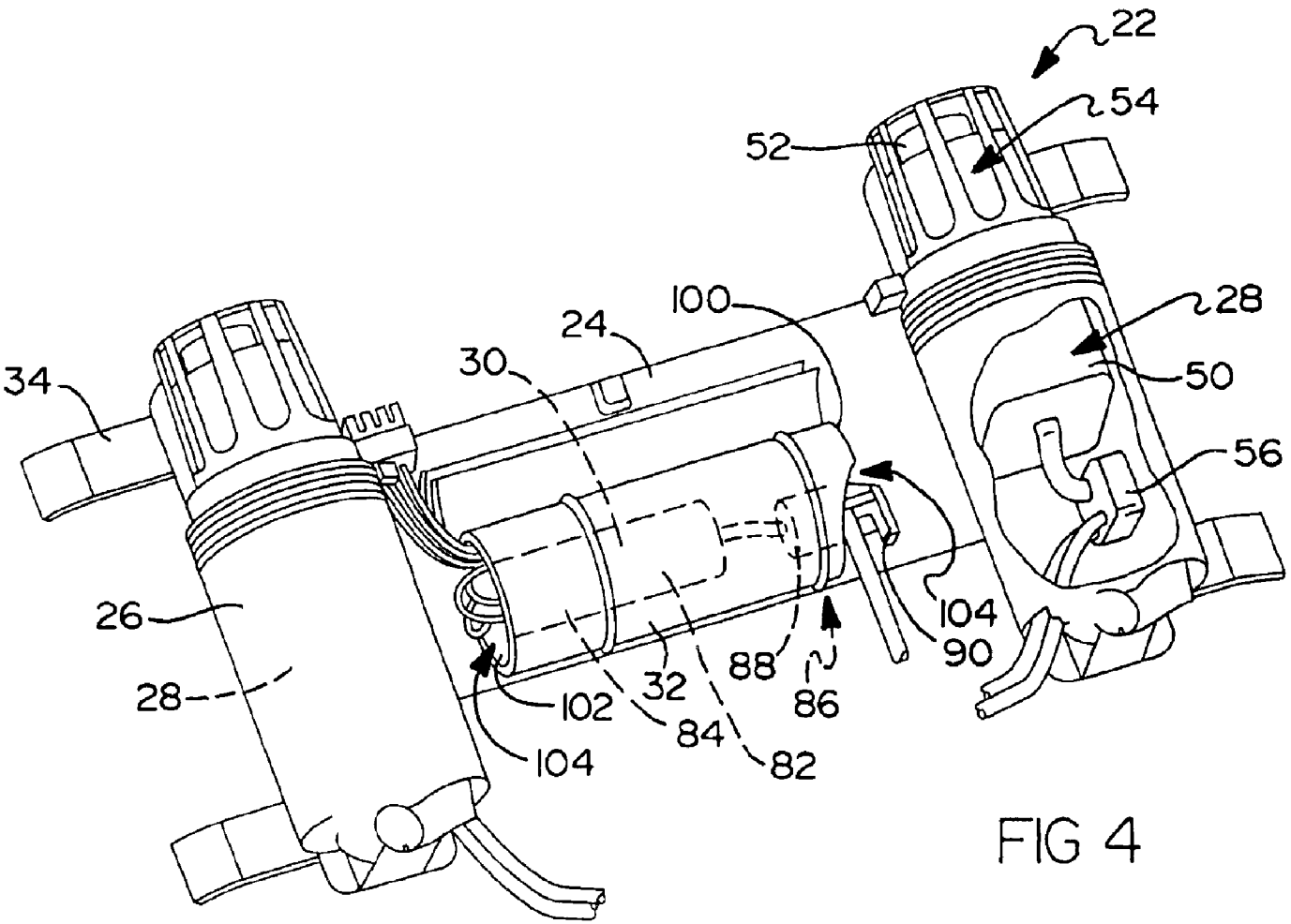
FIG. 4 is a perspective view of the fluidic control mounting system of FIG. 2.

Referring now to FIGS. 3 and 4, fluidic control system 22 is shown to include a carrier plate 24, a massage pouch 26, a massage pump assembly 28, a lumbar pump assembly 30 and a lumbar pouch 32. Fluidic control system 22 is preferably attached to seat back frame 16 with mounting straps 34.

Figure 5:
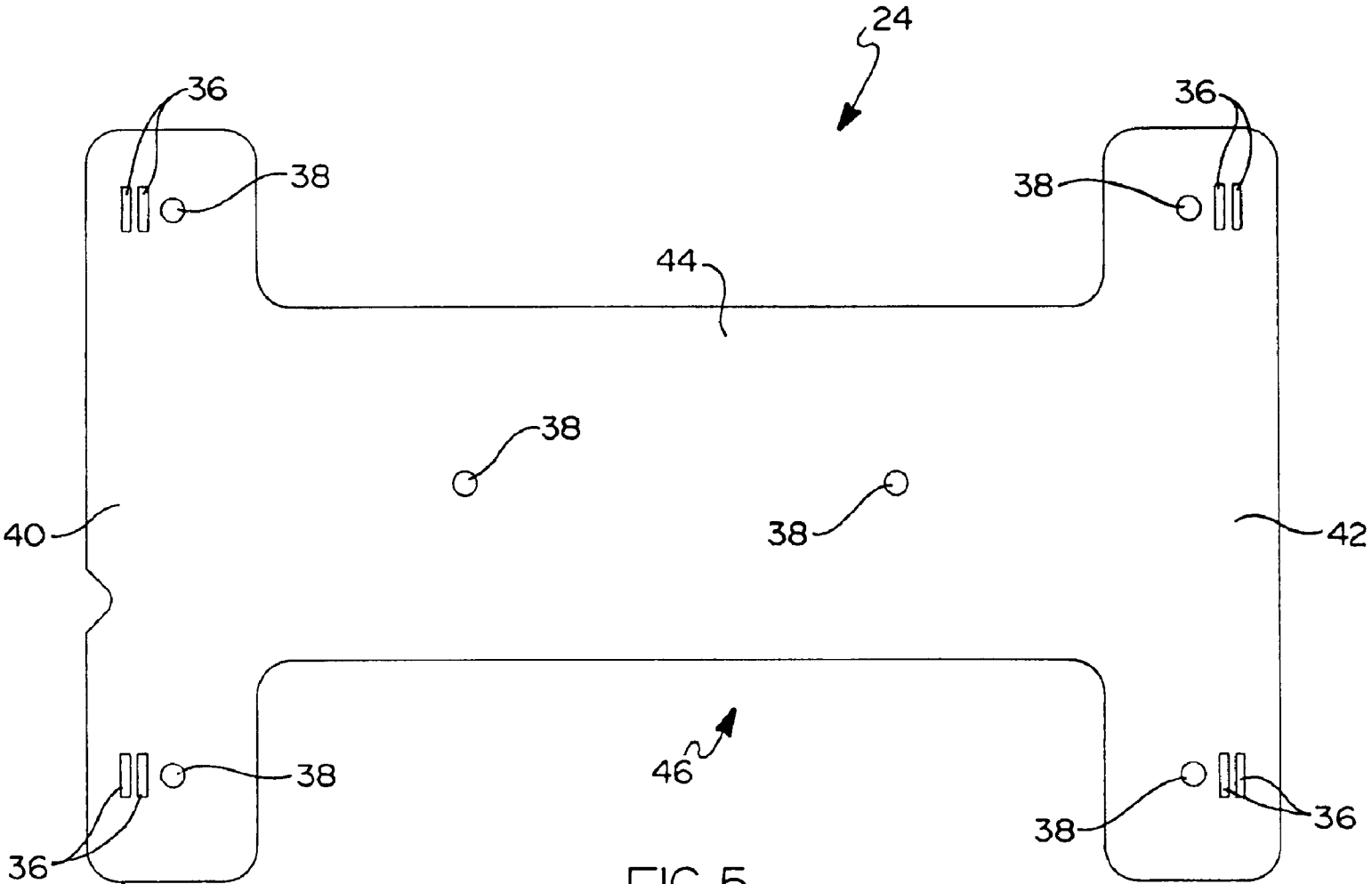
FIG. 5 is a detailed plan view of the carrier plate shown in FIG. 2.

With specific reference to FIG. 5, carrier plate 24 is shown to include attachment apertures 36, mounting apertures 38, a first portion 40, a second portion 42, and a central portion 44 defining a recess 46. Carrier plate 24 is preferably constructed of an injection molded material, and more preferably stamped from a sheet of 30 mm (0.12 inch) thick plastic. Preferably, mounting straps 34 are elastic straps that are disposed through attachment apertures 36 and fastened to seat back frame 16 with staples 48 as shown in FIG. 3.

As best seen in FIG. 4, massage pump assembly 28 is located within massage pouch 26. Massage pump assembly 28 includes a massage pump 50, a massage motor 52 having an external surface 54, and a fluidic assembly 56. Massage motor 52 is mechanically coupled to massage pump 50 and fluidic assembly 56 is coupled for fluid communication with massage pump 50. Preferably, fluidic assembly 56 is of the type disclosed in U.S. Pat. No. 6,260,945.

Massage pump assembly 28 is preferably disposed within massage pouch 26 such that fluidic assembly 56 and massage pump 50 are enclosed therein. Massage motor 52 may be at least partially enclosed by massage pouch 26, or in the alternative, may extend from massage pump assembly 28 outside massage pouch 26 (FIG. 4). When massage motor 52 is partially enclosed by massage pouch 26, a motor sleeve 58 is preferably interposed between massage motor 52 and massage pouch 26.

Figure 7:
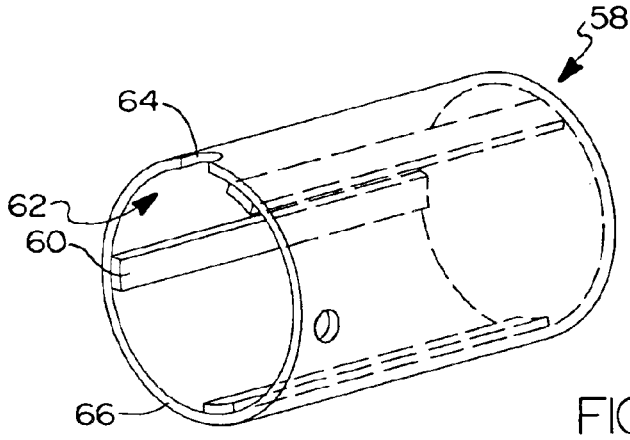
FIG. 7 is a perspective view of the motor sleeve of FIG. 6.

Referring to FIG. 7, motor sleeve 58 is preferably a hollow, generally cylindrical member that includes motor spacers 60 that extend radially from an internal surface 62 of motor sleeve 58. Also preferably, motor sleeve 58 defines a notch 64 at a lower end 66. In operation, motor spacers 60 ensure a minimum clearance between internal surface 62 of motor sleeve 58 and external surface 54 of massage motor 52. In this manner, heat generated by massage motor 52 is more readily dissipated from external surface 54. Motor sleeve 58 is preferably constructed of a heat insulating material and more preferably of acrylic.

Figure 6:
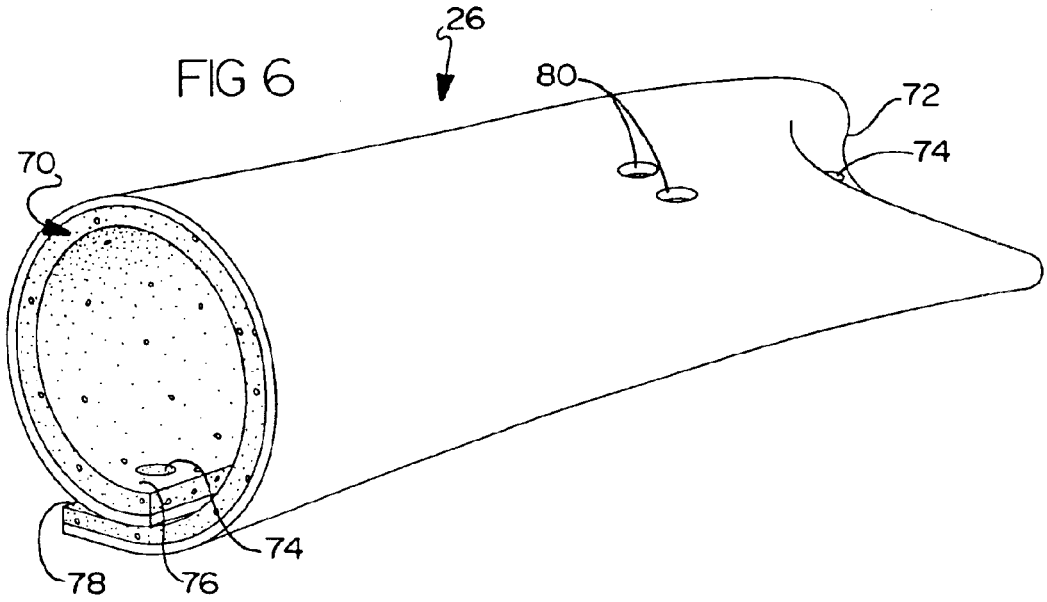
FIG. 6 is a perspective view showing the pouch of FIG. 4 in an alternate embodiment.

As best seen in FIGS. 3, 4, and 6, massage pouch 26 has an open end 70, a closed end 72, attachment apertures 74, a first overlapping portion 76, a second overlapping portion 78, and tubing apertures 80. Preferably, massage pouch 26 is constructed of folded or rolled vinyl or rubber and more preferably of a vinyl reinforced foam. Massage pouch 26 encloses massage pump assembly 28 as shown in FIG. 4 with massage pump 50 and fluidic assembly 56 essentially fully enclosed. Massage motor 52 is preferably positioned at least partially within massage pouch 26 near the open end 70 to encourage dissipation of heat that is generated by operation of massage motor 52. As discussed above, motor sleeve 58 may be interposed between massage pouch 26 and massage motor 52. Massage pouch 26 is preferably attached to carrier plate 24 and oriented such that open end 70 is at the top most portion of massage pouch 26. In this manner, massage pouch 26 can contain a massage pump assembly 28 while restricting movement therebetween.

Lumbar pump assembly 30 is a conventional lumbar pressure control assembly that includes a lumbar pump 82, a lumbar motor 84 and a solenoid control 86. Briefly, lumbar pump 82 is operated by lumbar motor 84 to supply pressurized air to solenoid 86. Solenoid control 86 includes a solenoid 88 operably connected to a three-way valve 90 that is in fluid communication with a lumbar air pillow (not shown), and a vent 92.

With specific reference to FIG. 4, lumbar pouch 32 is preferably constructed of similar material as massage pouch 26 and includes a first end 100, a second end 102 and connection apertures 104. It would be envisioned that pouches 26, 32 could be constructed of other materials suitable for a fluidic control mounting application.

During assembly of fluidic control system 22, fasteners 120 are used to mount pouches 26, 32 to carrier plate 24. As best seen in FIG. 6, massage pouch 26 is formed by rolling a sheet of material such that the first overlapping portion 76 is adjacent the second overlapping portion 78. Mounting apertures 38 are formed in both the first overlapping portion 76 and second overlapping portion 78. As best seen in FIGS. 3 and 4, closed end 72 of massage pouch 26 is formed by inserting a fastener 120 through attachment apertures 74 of overlapping portions 76, 78 and then through an attachment aperture 74 formed in a portion of massage pouch 26 that is radially opposite overlapping portions 76, 78. Open end 70 of massage pouch 26 is formed by inserting a fastener 120 through attachment apertures 74 of overlapping portions 76, 78. In this manner, massage pouch 26 can be provided to enclose at least a portion of massage pump assembly 28. Fasteners 120 can be inserted through mounting apertures 38 prior to insertion through attachment apertures 74, thereby mounting massage pouches 26 to carrier plate 24. Tubing 122, interconnecting fluidic assembly 56 and a massage air pillow, can be routed through tubing apertures 80.

For assembly of lumbar pouch 32, a sheet of material is folded so as to enclose lumbar pump assembly 30 as seen in FIG. 3. A fastener is inserted through apertures 38 and 104 so as to secure lumbar pouch 32 to carrier plate 24. It is envisioned that apertures 74, 104 can be formed in pouches 26, 32 by a punch, a piercing fastener, or by any suitable means that will form an aperture.

Mounting straps 34 are threaded through attachment apertures 36 and fastened to seat back frame 16. Preferably, mounting straps 34 are stapled to seat back frame 16. In this manner, recess 46 is positioned so as to prevent interference of carrier plate 24 with furniture components 20, and mounting straps 34 provide clearance between fluidic control system 22 and seat back frame 16 to allow for additional furniture components 20. Thus provided, the fluidic control mounting system of the present invention is well suited for mounting within a seat back of an article of furniture. The mounting of carrier plate 24 to seat back 14 provides a flexible fluidic control mounting system that will afford a degree of vibration and noise isolation. Preferably, furniture components 20 include power converters and other components that would not benefit from a flexible mounting system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An article of furniture of the type having a pneumatic control system comprising:

a seat back;

a carrier plate elastically supported from the seat back;

an air pump positioned within a pouch mounted to the carrier plate and in fluid communication with an air pillow;

an electric motor at least partially disposed in the pouch, wherein the pouch includes an open end adapted to encourage heat dissipation from the motor; and a motor sleeve including internal spacers and enclosing at least a portion of the electric motor, wherein the motor sleeve is positioned at least partially within the pouch and is adapted to encourage heat dissipation from the motor through the open end of the pouch.

2. The article of furniture of claim 1, wherein the pouch is constructed of a material selected from the group consisting of reinforced foam, vinyl and rubber.

3. The article of furniture of claim 1, wherein an elastic strap is interposed between the carrier plate and the seat back.

4. The article of furniture of claim 3, wherein the elastic strap is fastened to the seat back with staples.

5. The article of furniture of claim 1, further comprising a second pump mounted to the carrier plate and in fluid communication with a second air pillow.

6. The article of furniture of claim 5, further comprising a third pump mounted to the carrier plate wherein the third pump is in fluid communication with a third air pillow.

7. The article of furniture of claim 1, further comprising an air pillow attached to the seat back, wherein the air pillow is in fluid communication with the air pump and adapted to inflate in reaction to pressurized air supplied from the pump.

8. The article of furniture of claim 1, wherein the carrier plate is formed from a sheet of plastic.

9. The article of furniture of claim 1, wherein the carrier plate includes a first end, a second end, and a central portion, wherein the central portion has a recess adapted to provide clearance for a furniture component.

10. The article of furniture of claim 1, wherein the carrier plate is formed from a sheet of plastic.

11. The article of furniture of claim 1, wherein the carrier plate includes a first end, a second end, and a central portion, wherein the central portion has a recess adapted to provide clearance for a furniture component.

* * * * *